US005958352A

United States Patent [19]

Callaway et al.

[11] Patent Number: 5,958,352

[45] Date of Patent: Sep. 28, 1999

[54] ABATEMENT OF HYDROGEN SULFIDE WITH AN ALDEHYDE AMMONIA TRIMER

[75] Inventors: Michael Callaway, Sapulpa, Okla.; Gordon T. Rivers, Houston, Tex.

[73] Assignee: Baker Hughes Incorporated, Houston, Tex.

[21] Appl. No.: 08/792,961

[22] Filed: Jan. 24, 1997

Related U.S. Application Data

[63] Continuation-in-part of application No. 08/471,258, Jun. 6, 1995, abandoned.

[51] Int. Cl.[6] ..... C07C 7/20; B01D 17/00

[52] U.S. Cl. ..... 423/228; 423/226; 210/749; 585/860

[58] Field of Search ..... 423/226, 228; 585/860; 210/749

[56] References Cited

U.S. PATENT DOCUMENTS

| | | | |
|---|---|---|---|
| 1,951,992 | 3/1934 | Perkins . | |
| 2,496,596 | 2/1950 | Moyer et al. . | |
| 2,596,273 | 5/1952 | Moyer et al. . | |
| 2,596,425 | 5/1952 | Moyer et al. . | |
| 2,729,679 | 1/1956 | Anderson . | |
| 2,783,205 | 2/1957 | Brooks et al. . | |
| 3,770,377 | 11/1973 | Scott et al. | 252/390 |
| 4,106,904 | 8/1978 | Alink et al. | 252/392 |
| 4,112,049 | 9/1978 | Bozzelli et al. | 423/226 |
| 4,266,054 | 5/1981 | Au | 544/215 |
| 4,523,947 | 6/1985 | Szczepanski et al. | 544/194 |
| 4,680,127 | 7/1987 | Edmondson | 423/226 |
| 4,748,011 | 5/1988 | Baize | 423/228 |
| 4,877,578 | 10/1989 | Zetlmeisl et al. | 252/390 |
| 4,894,178 | 1/1990 | Ho et al. | 252/190 |
| 4,978,512 | 12/1990 | Dillon | 423/226 |
| 5,128,049 | 7/1992 | Gatlin | 423/228 |
| 5,213,680 | 5/1993 | Kremer et al. | 208/236 |
| 5,347,003 | 9/1994 | Trauffer et al. | 423/228 |
| 5,347,004 | 9/1994 | Rivers et al. | 544/180 |
| 5,387,393 | 2/1995 | Braden et al. | 252/390 |
| 5,488,103 | 1/1996 | Gatlin | 564/472 |
| 5,498,707 | 3/1996 | Gatlin | 564/471 |

FOREIGN PATENT DOCUMENTS

| | | |
|---|---|---|
| 0411745 A1 | 5/1990 | European Pat. Off. . |
| 411745A1 | 5/1990 | European Pat. Off. . |
| 0438812 A1 | 12/1990 | European Pat. Off. . |
| 438812A1 | 12/1990 | European Pat. Off. . |
| 0636675A2 | 7/1994 | European Pat. Off. . |
| 2290542 | 1/1996 | United Kingdom . |
| WO92/01481 | 7/1991 | WIPO . |
| WO 92/01481 | 2/1992 | WIPO . |
| WO 94/08980 | 4/1994 | WIPO . |

OTHER PUBLICATIONS

Chemical Abstracts, v. 115:95465 1991.
Chem. Abs., vol. 119 #143774 (1991).
Chemical Abstracts, v. 115:117229 (1991).
Chemical Abstracts, v. 90:637–638 (1979).
J. F. Walder, "Formaldehyde". Reinhold New York, pp. 360–361 (1964).
Chemical Abstracts, vol. 115:95451c, 1991.
Chemical Abstracts, vol. 115:117229r, 1991.
J.F. Walker, Formaldehyde, Reinhold, New York, 1964, pp. 360–361, 610.
E.T. Dillon, "Triazines Sweeten Gas Easier," Hydrocarbon Processing, Dec., 1991, pp. 65–66.
Chemical Abstracts, 28–Heterocycles, vol. 90, 1979, p. 637.

*Primary Examiner*—Michael Lewis
*Assistant Examiner*—Peter DiMauro
*Attorney, Agent, or Firm*—Madan & Morris, PC

[57] ABSTRACT

The present invention provides a method for scavenging $H_2S$ from aqueous and hydrocarbon substrates, preferably natural gas, using aldehyde ammonia trimers.

14 Claims, No Drawings

ABATEMENT OF HYDROGEN SULFIDE WITH AN ALDEHYDE AMMONIA TRIMER

This is a continuation-in-part of application Ser. No. 08/471,258, filed Jun. 6, 1995, (abandoned).

FIELD OF THE INVENTION

The invention relates to chemical compositions and methods for scavenging sulfhydryl compounds, particularly hydrogen sulfide ($H_2S$), from "sour" aqueous and hydrocarbon substrates. More particularly, the invention relates to the use of aldehyde ammonia trimers as scavengers for sulfhydryl compounds in natural gas.

BACKGROUND OF THE INVENTION

The removal of $H_2S$ from a liquid or gaseous hydrocarbon stream is a problem that has challenged many workers in many industries. One such industry is the petroleum industry, where the $H_2S$ content of certain crudes from reservoirs in many areas of the world is too high for commercial acceptance. The same is true of many natural gas streams. Even where a crude or gas stream contains only a minor amount of sulfur, the processes to which the crude oil or fractions thereof are subjected often produce one or more hydrocarbon streams that contains $H_2S$.

The presence of $H_2S$ in hydrocarbon streams presents many environmental and safety hazards. Hydrogen sulfide is highly flammable, toxic when inhaled, and strongly irritates the eyes and other mucous membranes. In addition, sulfur-containing salts can deposit in and plug or corrode transmission pipes, valves, regulators, and the like. Flaring of natural gas that contains $H_2S$ does not solve the problem for gas streams because, unless the $H_2S$ is removed prior to flaring, the combustion products will contain unacceptable amounts of pollutants, such as sulfur dioxide ($SO_2$)—a component of "acid rain."

Hydrogen sulfide has an offensive odor, and natural gas containing $H_2S$ often is called "sour" gas. Treatments to reduce or remove $H_2S$ from hydrocarbon or other substrates often are called "sweetening" treatments. The agent that is used to remove or reduce $H_2S$ levels sometimes is called a "scavenging agent." The sweetening or scavenging of $H_2S$ from petroleum or natural gas is only one example of where $H_2S$ level reduction or removal must be performed. Many aqueous substrates also must be treated to reduce or remove $H_2S$.

In the manufactured gas industry, or the coke-making industry, the destructive distillation of bituminous coal with a high sulfur content commonly produces coal gas containing an unacceptable amount of $H_2S$. Another $H_2S$ contamination problem arises during the manufacture of water gas or synthesis gas. Water gas or synthesis gas streams that contain $H_2S$ often are produced by passing steam over a bed of incandescent coke or coal. The incandescent coke or coal often contains a minor amount of sulfur, which contaminates the resulting gas stream.

The problem of removing or reducing $H_2S$ from hydrocarbon and aqueous substrates has been solved in many different ways in the past. Most of the known techniques involve either (a) absorption, or selective absorption by a suitable absorbent, after which the absorbent is separated and the sulfur removed to regenerate and recycle the absorbent, or (b) selective reaction with a reagent that produces a readily soluble product. A number of known systems treat a hydrocarbon stream with an amine, an aldehyde, an alcohol, and/or a reaction product thereof. The wide variety of processes, patents, and publications that describe methods for removing $H_2S$ from hydrocarbon streams is evidence that it is desirable and necessary to remove $H_2S$ from aqueous and hydrocarbon streams.

A continuing need exists for alternative processes and compositions to reduce and/or remove $H_2S$ from aqueous and hydrocarbon substrates.

SUMMARY OF THE INVENTION

The present invention provides a method for scavenging $H_2S$ from aqueous and hydrocarbon substrates, preferably natural gas, using aldehyde ammonia trimers.

DETAILED DESCRIPTION OF THE INVENTION

The scavenging agents of the present invention may be used to treat aqueous and hydrocarbon substrates that are rendered "sour" by the presence of "sulfhydryl compounds," such as hydrogen sulfide ($H_2S$), organosulfur compounds having a sulfhydryl (—SH) group, known as mercaptans, also known as thiols (R—SH, where R is a hydrocarbon group), thiol carboxylic acids (RCO—SH), dithio acids (RCS—SH), and related compounds.

As used in this application, the term "aqueous substrate" refers to any "sour" aqueous substrate, including waste water streams in transit to or from municipal waste water treatment facilities, tanning facilities, and the like.

The term "hydrocarbon substrate" is meant to include unrefined and refined hydrocarbon products, including natural gas, derived from petroleum or from the liquefaction of coal, both of which contain hydrogen sulfide or other sulfur-containing compounds. Thus, particularly for petroleum-based fuels, the term "hydrocarbon substrate" includes wellhead condensate as well as crude oil which may be contained in storage facilities at the producing field. "Hydrocarbon substrate" also includes the same materials transported from those facilities by barges, pipelines, tankers, or trucks to refinery storage tanks, or, alternately, transported directly from the producing facilities through pipelines to the refinery storage tanks. The term "hydrocarbon substrate" also includes refined products, interim and final, produced in a refinery, including distillates such as gasolines, distillate fuels, oils, and residual fuels. As used in the claims, the term "hydrocarbon substrate" also refers to vapors produced by the foregoing materials.

A wide variety of aqueous and hydrocarbon substrates can be treated using the scavenging agents of the present invention, a preferred substrate being natural gas. The trimers preferably should be added to the substrate at a high enough temperature that the substrate is flowable for ease in mixing. The treatment may take place at temperatures up to the temperature at which the material being treated begins to decompose. Preferred treatment temperatures are between ambient to about 65.6° C. (150° F.).

The scavenging agents of the present invention are aldehyde ammonia trimers that generally have the following formula:

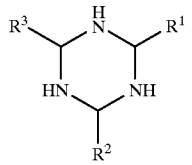

wherein $R^1$, $R^2$, and $R^3$ are independently selected from the group consisting of hydrogen and hydrocarbon groups having between about 1–8 carbon atoms, selected from the group consisting of straight, branched, and cyclic alkyl groups, aryl, alkaryl, and aralkyl groups, and heterocyclic alkyls containing oxygen or tertiary nitrogen as a ring constituent wherein none of $R^1$, $R^2$, or $R^3$ is an alkoxyalkylene substitutent. In a preferred embodiment, $R^1$, $R^2$, and $R^3$ are methyl groups.

The aldehyde ammonia trimers of the present invention exhibit a high uptake capacity for hydrogen sulfide, and the raw materials required to manufacture the trimers are low cost materials.

Aldehyde ammonia trimers are commercially available in small quantities from Aldrich Chemical Co., Milwaukee, Wis. Aldehyde ammonia trimers also may be manufactured by reacting acetaldehyde with aqueous ammonia in a 1:1 molar ratio. Water or another solvent, such as methanol, can be used in the reaction to prevent solid trimer from precipitating out of the solution. The amount of water used may vary depending upon how the product will be used. For example, if the substrate will be hydrophobic, e.g., a dry oil phase, the trimer may be formulated in isopropanol rather than water. In the field, the trimer preferably should be used in a solution having an active concentration of about 2–30%, preferably about 10–20%.

In a preferred embodiment, the substrate is natural gas and the trimer is added at a stoichiometric ratio of at least one molecule of trimer per three molecules of $H_2S$. The ratio preferably should be somewhat higher than 1:3 to assure abatement of $H_2S$. Preferably, between about 0.8–1.7 ppm of scavenger should be added per ppm of $H_2S$, most preferably about 1.3 ppm per 1 ppm of $H_2S$.

The amount of $H_2S$ in the natural gas may be measured by standard means. For ease in measurement, about: one gallon of the 10–20% active trimer solution may be added for every pound of $H_2S$.

The aqueous or hydrocarbon substrates should be treated with the scavenging agent until reaction with hydrogen sulfide, or with other sulfhydryl compounds, has produced a product in which the sulfhydryls in the vapor (or liquid) phase have been removed to an acceptable or specification grade product. Typically, a sufficient amount of scavenging agent should be added to reduce the sulfhydryls in the vapor phase to at least about 4 ppm or less.

The invention will be better understood with reference to the following examples:

EXPERIMENTAL PROCEDURES

The Bubble Tower Test

In the following examples, the effectiveness of the scavenging agent is tested in an apparatus known as a "bubble tower." The "bubble tower" is a transparent acrylic column having a preferred internal diameter of 1.25 inches. In order to test a particular scavenging agent, a solution of the scavenging agent is placed in the column to a given height, and gas having a known composition is bubbled through the solution. In the following experiments: the gas contains 2000 ppm $H_2S$, 1% $CO_2$, and a balance of methane; the $H_2S$ content of the gas exiting the solution is measured at given time intervals; and, measurements are made using stain tubes obtained from Sensidyne Gastech, located in Largo, Fla. The solution is observed for foaming and for precipitate formation, both of which are undesirable. Generally, only candidates that exhibit minimum foaming and little to no precipitate formation are selected for further study. Foaming may be desirable for some applications; however, foaming generally is undesirable when treating natural gas in a bubble tower. The amount of foaming that results using a given candidate generally may be altered using defoaming compositions. In the following examples, foaming is given as a measure of column height. Basically, the less the increase in column height, the less foam has been generated by the candidate.

To perform the "bubble tower" test, the following steps are performed:

1. Prepare 100 grams of a bulk dilution or a 5% active solution (if activity is known) of the scavenging agent in distilled water;
2. Place the solution in the "bubble tower" and pressurize the solution to 20 psi.
3. Adjust the flow rate of the test gas to 5.5 standard cubic feet per hour (scfh).
4. Record the outlet $H_2S$ concentration at 1, 5, 10, and 15 minutes and every 15 minutes thereafter until $H_2S$ levels reach inlet levels.
5. Observe for foaming and solids formation up to 24 hrs.

The Uptake Test

The uptake test determines the activity of a particular candidate by measuring the weight gain of the candidate before and after exposure to pure $H_2S$ gas. Basically, 100 grams of a 5% solution of candidate in water is placed in a graduated cylinder with a dispersion stone and the total weight of the solution and the cylinder is measured using a balance. Thereafter, pure $H_2S$ gas is bubbled through the cylinder at 1 scfh. The weight of the solution is monitored until the weight remains substantially constant. The total weight gain is a measure of the activity of the candidate.

Example 1

Aldehyde trimer for use in the following experiments was prepared as follows. A 500 ml three-necked reaction flask containing 169.4 g of 28% by weight aqueous ammonia and equipped with a magnetic stirrer, a reflux condenser, a pressure equalizing dropping funnel, and a thermometer was cooled in an ice bath. Chilled acetaldehyde (122.8 g) was added dropwise at such a rate as to keep the internal temperature below 30° C. (86° F.) to yield a white suspension. The suspension wets dissolved by adding 107.6 g of methanol and 40.0 g of water to yield a colorless solution containing 27.25% by weight reaction product. Proton and carbon NMR spectroscopy performed on the solution before and after the dissolution in methanol and water confirmed that the primary reaction product was an aldehyde ammonia trimer having the following structure:

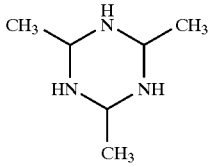

Example 2

The aldehyde ammonia trimer prepared in Example 1 was used to scavenge sulfur-containing compounds from natural gas. The efficacy of the aldehyde ammonia trimer was tested using the bubble tower test, described under "Experimental Procedures." The $H_2S$ concentration in the outlet gas and the change in height due to foaming are reflected in Table I:

TABLE I

| TIME | OUTLET [$H_2S$] (ppm) | COLUMN HEIGHT (inches) |
|---|---|---|
| 1 minute | 0 | 7 |
| 5 minutes | 0 | 6 |
| 10 minutes | 0 | 6 |
| 15 minutes | 0.1 | 12 |
| 30 minutes | 4.2 | 12 |
| 45 minutes | 10 | 12 |
| 60 minutes | 60 | 12 |
| 75 minutes | | |
| 90 minutes | 1300 | 12 |
| 105 minutes | 1600 | 11 |
| 120 minutes | 1600 | 11 |

After 24 hours, a 2 phase liquid reaction product was formed which contained no solids.

Example 2

The aldehyde ammonia trimer of Example 1 was used in the "Uptake Test" outlined under "Experimental Procedures." The scavenger solution was made using 5.15 gm of aldehyde ammonia trimer. The results are given in Table II:

TABLE II

| MINUTES | WEIGHT OF CYLINDER (GM) |
|---|---|
| 0 | 199.9 |
| 5 | 202.3 |
| 10 | 202.9 |
| 15 | 203.3 |
| 20 | 203.4 |
| OVERALL WEIGHT CHANGE | +3.5 |

Example 4

Aldehyde ammonia trimer, prepared as set out in Example 1, was used to scavenge sulfur-containing compounds from natural gas. The efficacy of the aldehyde ammonia trimer was tested using the bubble tower test, described under "Experimental Procedures." The bubble tower used in this example had an internal diameter of 1.125" rather than 1.25".

The $H_2S$ concentration in the outlet gas and the change in height due to foaming are reflected in Table III:

TABLE III

| TIME | OUTLET [$H_2S$] (ppm) | COLUMN HEIGHT (inches) |
|---|---|---|
| 1 minute | 0 | 13+ |
| 5 minutes | 0 | 11 |
| 10 minutes | 2 | 10 |
| 15 minutes | 1.5 | 9 |
| 30 minutes | 11 | 9 |
| 45 minutes | 61 | 11 |
| 60 minutes | 275 | 12 |
| 75 minutes | 1200 | 13+ |
| 90 minutes | 1600 | 13+ |

Example 5

Aldehyde ammonia trimer was prepared as set out in Example 1, and used to scavenge sulfur-containing compounds from natural gas. 17.0 gm of the resulting trimer was diluted to a total of 100 gm of solution in distilled water. The efficacy of the aldehyde ammonia trimer was tested using a bubble tower with an internal diameter of 1.25".

The $H_2S$ concentration in the outlet gas and the change in height due to foaming are reflected in Table IV:

TABLE IV

| TIME | OUTLET [$H_2S$] (ppm) | COLUMN HEIGHT (inches) |
|---|---|---|
| 0 minute | 0 | 13 |
| 5 minutes | 0 | 12 |
| 10 minutes | 0.9 | 11 |
| 15 minutes | 1.0 | 12 |
| 30 minutes | 7.0 | 12 |
| 45 minutes | 24 | 12 |
| 60 minutes | 125 | 12 |
| 75 minutes | 900 | 12 |
| 90 minutes | 1350 | 12 |
| 105 minutes | 1600 | 12 |

No solids formed in the test solution after 24 hours.

Example 6

Aldehyde ammonia trimer was prepared as set out in Example 1, and the procedures given in Example 5 were repeated. The $H_2S$ concentration in the outlet gas and the change in height due to foaming are reflected in Table IV:

TABLE V

| TIME | OUTLET [$H_2S$] (ppm) | COLUMN HEIGHT (inches) |
|---|---|---|
| 0 minute | 0 | 11 |
| 5 minutes | 0 | 9 |
| 10 minutes | 1.0 | 9 |
| 15 minutes | 1.0 | 9 |
| 30 minutes | 7.0 | 8 |
| 45 minutes | 24 | 8 |
| 60 minutes | 125 | 8 |
| 75 minutes | 900 | 12 |
| 90 minutes | 1350 | 12 |
| 105 minutes | 1600 | 12 |

Less than 1% by volume of crystalline solid precipitate formed after 24 hours.

Example 7

The uptake test was performed on a 6% active solution of aldehyde ammonia trimer prepared as in Example 1 and the Uptake Test was performed. The total $H_2S$ uptake was 4.6 gm.

Example 8

Acetaldehyde trimer obtained from Aldrich Chemical Co. was used to prepare a 4.23% active solution and the Uptake Test was performed. The total $H_2S$ uptake was 3.5 gm.

The foregoing examples demonstrate that; the aldehyde trimers of the present invention exhibit high uptake efficiency for hydrogen sulfide, do not exhibit an undesirable level of foaming, and do not exhibit an undesirable level of precipitate formation.

Persons of skill in the art will appreciate that many modifications may be made to the embodiments described herein without departing from the spirit of the present invention. Accordingly, the embodiments described herein are illustrative only and are not intended to limit the scope of the present invention.

I claim:

1. A method for reducing an amount of sulfhydryl compounds in sour aqueous and sour hydrocarbon substrates comprising scavenging said sulfhydryl compounds from said substrate with a scavenging agent comprising aldehyde ammonia trimers which trimers contain no alkoxyalkylene substituents, wherein said aldehyde ammonia trimers are present in an amount sufficient to reduce said amount of said sulfhydryl compounds in said substrate.

2. The method of claim 1 wherein said aldehyde ammonia trimer comprises the following general structure:

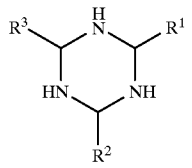

wherein $R^1$, $R^2$, and $R^3$ are independently selected from the group consisting of hydrogen and hydrocarbon groups having between about 1–8 carbon atoms, wherein said hydrocarbon groups are selected from the group consisting of straight, branched, and cyclic alkyl groups, aryl, alkaryl, and aralkyl groups, and heterocyclic alkyls containing oxygen or tertiary nitrogen as a ring constituent.

3. The method of claim 2 wherein R1, $R^2$, and R3 are methyl groups.

4. The method of claim 2 wherein said substrate is natural gas.

5. The method of claim 3 wherein said substrate is natural gas.

6. The method of claim 1 wherein said substrate is treated at a temperature of between ambient to about 65.6° C.

7. The method of claim 2 wherein said substrate is treated at a temperature of between ambient to about 65.6° C.

8. The method of claim 3 wherein said substrate is treated at a temperature of between ambient to about 65.6° C.

9. The method of claim 4 wherein said substrate is treated at a temperature of between ambient to about 65.6° C.

10. The method of claim 1 wherein said effective amount of said scavenging agent is between about 0.8–1.7 ppm of scavenger for every 1 ppm of hydrogen sulfide in substrate.

11. The method of claim 2 wherein said effective amount of said scavenging agent is between about 0.8–1.7 ppm of scavenger for every 1 ppm of hydrogen sulfide in substrate.

12. The method of claim 3 wherein said effective amount of said scavenging agent is between about 0.8–1.7 ppm of scavenger for every 1 ppm of hydrogen sulfide in substrate.

13. The method of claim 3 wherein said effective amount of said scavenging agent is between about 0.8–1.7 ppm of scavenger for every 1 ppm of hydrogen sulfide in substrate.

14. A method for reducing an amount of sulfhydryl compounds in natural gas comprising scavenging said natural gas with a scavenging agent comprising aldehyde ammonia trimers which trimers contain no alkoxyalkylene substituents, wherein said aldehyde ammonia trimers are present in and amount sufficient to reduce said amount of said sulfhydryl compounds in said substrate.

* * * * *